US006174193B1

(12) United States Patent
Nagano

(10) Patent No.: US 6,174,193 B1
(45) Date of Patent: Jan. 16, 2001

(54) INTERFITTING STRUCTURE OF CONNECTOR

(75) Inventor: Toru Nagano, Shizuoka-ken (JP)

(73) Assignee: Yazaki Corporation, Tokyo (JP)

( * ) Notice: Under 35 U.S.C. 154(b), the term of this patent shall be extended for 0 days.

(21) Appl. No.: 09/268,692

(22) Filed: Mar. 16, 1999

(51) Int. Cl.[7] ..... H01R 13/58
(52) U.S. Cl. ..... 439/468
(58) Field of Search ..... 439/468, 350–358

(56) References Cited

U.S. PATENT DOCUMENTS 4,708,662 * 11/1987 Klein ..... 439/353

FOREIGN PATENT DOCUMENTS 7-298450 11/1995 (JP) .

* cited by examiner

*Primary Examiner*—Gary F. Paumen
(74) *Attorney, Agent, or Firm*—Finnegan, Henderson, Farabow, Garrett & Dunner, L.L.P.

(57) ABSTRACT

An interfitting structure of a connector includes: an engaging portion provided on a connector housing; an engaging portion provided on a cover opening and closing one surface side of the connector housing; and a rib provided on an inner side of the engaging portion of the cover. The rib abuts against an inner side wall of the engaging portion of the connector housing. The one surface side of the connector housing is covered by the cover by engagement of the both engaging portions with each other so as to construct a connector. Furthermore, a first clearance is provided between an inner side wall of the engaging portion of the cover and an outer side wall of the engaging portion of the connector housing, and a second clearance is provided between the inner side wall of the engaging portion of the connector housing and the rib.

4 Claims, 3 Drawing Sheets

INTERFITTING STRUCTURE OF CONNECTOR

BACKGROUND OF THE INVENTION

1. Field of the Invention

The present invention relates to an interfitting structure of a connector made of synthetic resin and having an engaging structure of a connector housing and a cover.

2. Description of the Related Art

As this type of connector there is that disclosed in Japanese Patent Application Laid-Open No, 7-298450 and shown in FIGS. 1 and 2. The connector illustrated in FIG. 1 is constituted by a connector housing 2 and a cover 3 whose cross section is horizontally U shaped and which opens and closes a rear surface 2*a* side of the connector housing 2. On upper and lower surfaces on the rear surface 2*a* side of the connector housing 2 there are protectively formed a plurality of engaging pawls 4. Also, at the positions, opposed to the respective engaging pawls 4, of upper and lower side portions of the cover 3 there are projectively formed, respectively, square-frame like engaging arms 5 that are engaged with or disengaged from their corresponding respective engaging pawls 4.

And, by engaging the respective engaging arms 5 of the cover 3 with their corresponding respective engaging pawls 4 of the connector housing 2, a wire harness W drawn out from the rear surface 2*a* of the connector housing 2 is protected by the cover 3.

Also, a connector 1' illustrated in FIG. 2 is constituted by a connector housing 2' and a cover 3' whose cross section is horizontally U shaped and which opens and closes a rear surface 2*a* side of the connector housing 2'. On upper and lower surfaces on the rear surface 2*a* side of the connector housing 2' there are protectively formed a plurality of first engaging portions 6. At the positions biased toward one side portion of the upper and lower surfaces there are projectively formed second engaging portions 7 each consisting of a tapered engaging portion 7*a* and a stopper 7*b*. Also, at the positions, opposed to the first engaging portions 6, located inside the upper and lower side portions of the cover 3' there are protectively formed, respectively, first engaging portions 8 that are engaged with their corresponding first engaging portions 6. At the positions, opposed to between the tapered engaging portions 7*a* and their corresponding stoppers 7*b* of the second engaging portions 7, located inside the upper and lower side portions of the cover 3' there are projectively formed second engaging portions 9 each engaged with and disengaged from between the tapered engaging portion 7*a* and the stopper 7*b* and concurrently serving as a stopper.

And, the respective first engaging portions 8 of the cover 3' are inserted in a direction indicated by an arrow A in FIG. 2 between the respective first engaging portions 6 of the connector housing 2'. Then, the cover 3' is slid in its longitudinal direction (the direction indicated by an arrow B in FIG. 2) to thereby cause the second engaging portions 9 of the cover 3' to be retained by or engaged with between the tapered engaging portions 7*a* and their corresponding stoppers 7*b* of the second engaging portions 7. As a result of this, a wire harness not illustrated that has been drawn out from the rear surface 2*a* of the connector housing 2' is protected by being covered by the cover 3'.

However, the conventional interfitting structure of the conventional connector 1 had the drawback that upon application of an impact force to the cover 3 due to a drop-down or the like the engaging arms 5 of the cover 3 spread outward and as a result the engaging arms 5 were disengaged from the engaging pawls 4 of the connector housing 2 or this impact force was received directly by the engaging arms 5 and as a result the engaging arms 5 were damaged.

Also, although the above-described conventional connector 1' has a high strength against an impact applied thereto at the time of, for example, a down strop as well as against the disengagement, since the stopper 7*b* of the second engaging portion 7 of the connector housing 2' and the second engaging portion 9 of the cover 3' are not coaxial with the first engaging portion 6 of the connector housing 2' and the first engaging portion 8 of the cover 3', at the time of forming the connector housing 2' and cover 3' by the use of resin the structure of a forming mold becomes complex, followed by an increase in the cost of the connector. On the other hand, since the cover 3' is slid with respect to the connector housing 2' in the letter "L" directions (the arrows A, B indicated directions in FIG. 2) and engaged therewith, the direction in which the wire harness is drawn out is limited with the result that it was difficult to fix the wire harness by the cover 3'.

SUMMARY OF THE INVENTION

The present invention has been achieved with such points in mind.

It therefore is an object of the present invention to provide an interfitting structure of an inexpensive connector which can reliably prevent the disengagement and damage of the engaging portions of the cover and can increase the degree of freedom associated with the direction in which electric wires are drawn out.

To attain the above object, a first aspect of the present invention provides an interfitting structure of a connector which comprises: an engaging portion provided on a connector housing; an engaging portion provided on a cover opening and closing one surface side of the connector housing; and a rib provided on an inner side of the engaging portion of the cover, the rib abutting against an inner side wall of the engaging portion of the connector housing, wherein the one surface side of the connector housing is covered by the cover by engagement of the both engaging portions with each other, thereby constructing a connector; wherein a first clearance is provided between an inner side wall of the engaging portion of the cover and an outer side wall of the engaging portion of the connector housing; and wherein a second clearance is provided between the inner side wall of the engaging portion of the connector housing and the rib.

In this connector, since an impact force applied from the outside due to, for example, a down drop is absorbed by abutment of the rib of the cover against the inner side wall of the engaging portion of the connector housing, there is no possibility that the engaging portion of the cover will be disengaged from the engaging portion of the connector housing or the engaging portion of the cover will be damaged. Also, by the rib of the cover the state of engagement between the engaging portion of the connector housing and the engaging portion of the cover is reliably held.

According to a second aspect of the present invention, as it depends from the first aspect, there is provided the interfitting structure of a connector wherein the first clearance has been so set as to become larger than the second clearance.

In this connector, by abutment of the rib of the cover against the inner side wall of the engaging portion of the connector housing, the impact force applied from the outside due to, for example, a down drop is reliably absorbed, with the result that there is no possibility that the engaging portion of the cover will receive the impact force from the engaging portion of the connector housing.

According to a third aspect of the present invention, as it depends from the first aspect or the second aspect, there is provided the interfitting structure of a connector wherein the connector housing and the cover are formed by a mold with the use of a synthetic resin; wherein one of the engaging portion of the connector housing and the engaging portion of the cover is made into a hook-shaped engaging pawl; and wherein the other engaging portion is made to be an engaging recessed portion with or from which the engaging pawl is engaged or disengaged.

In this connector, since the engaging portion of the connector housing and the engaging portion of the cover have no such directionality as in the prior art in terms of the engagement direction therebetween, a mold for forming the cover and the connector housing is simplified to thereby reduce the cost of the connector and in addition there is increased the degree of freedom associated with the direction in which electric wires are drawn out from one surface side of the connector housing.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
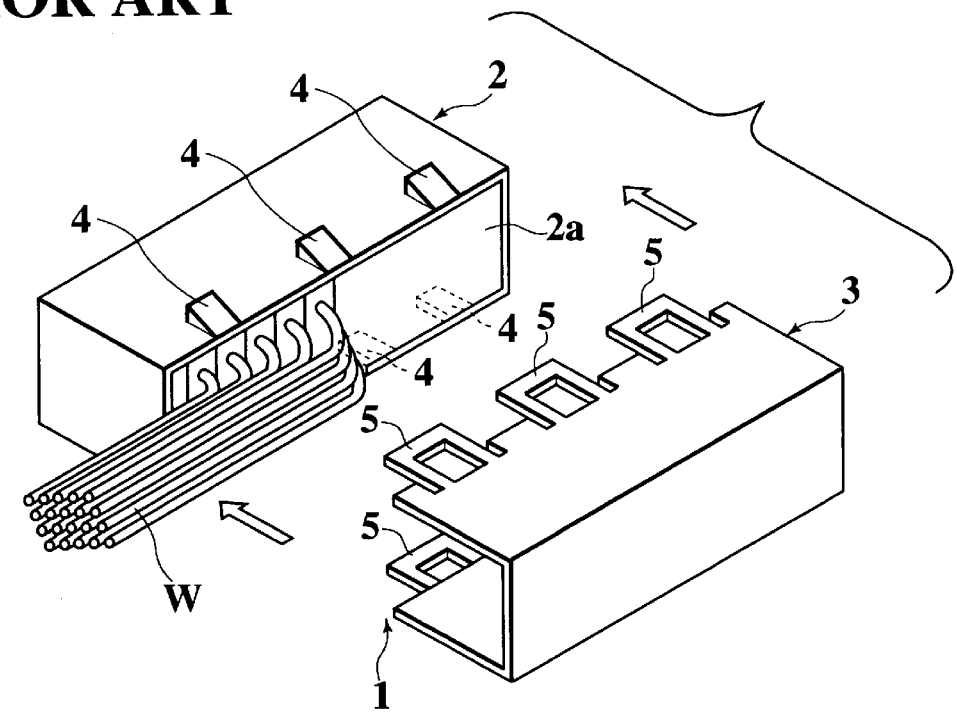
FIG.1 PRIOR ART
FIG. 1 is a perspective exploded view illustrating a conventional connector.
Figure 2:
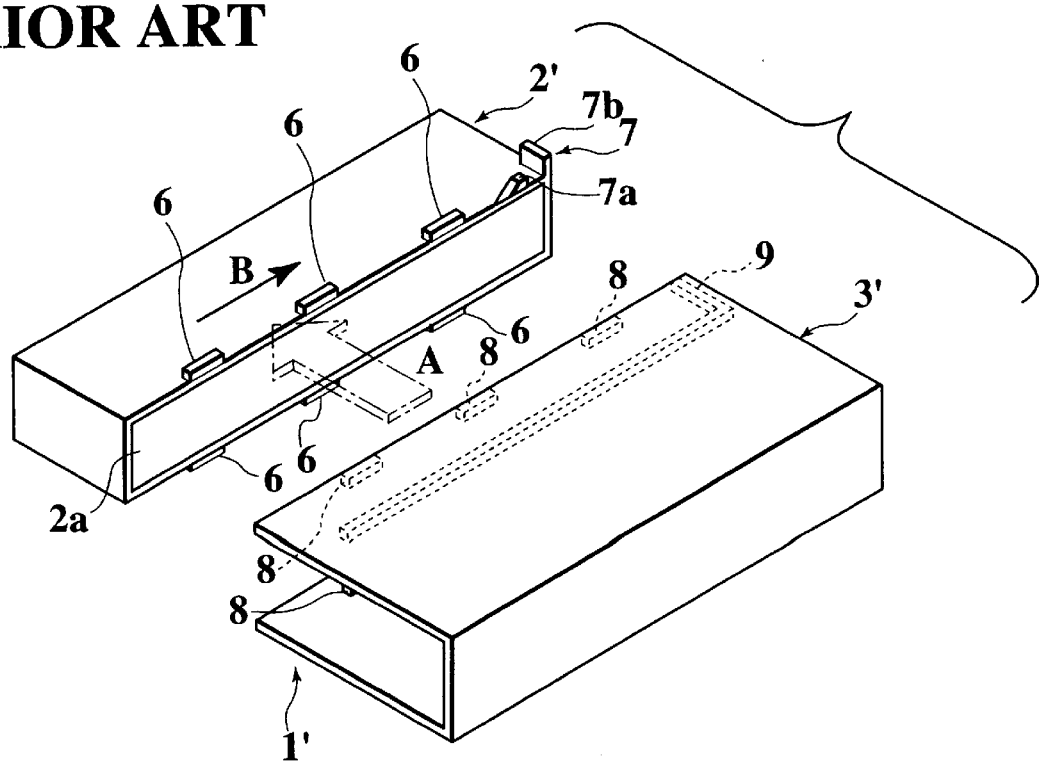
FIG.2 PRIOR ART
FIG. 2 is a perspective exploded view illustrating another conventional connector.

There will be detailed below the preferred embodiments of the present invention with reference to the accompanying drawings. Like members are designated by like reference characters.

Figure 3:
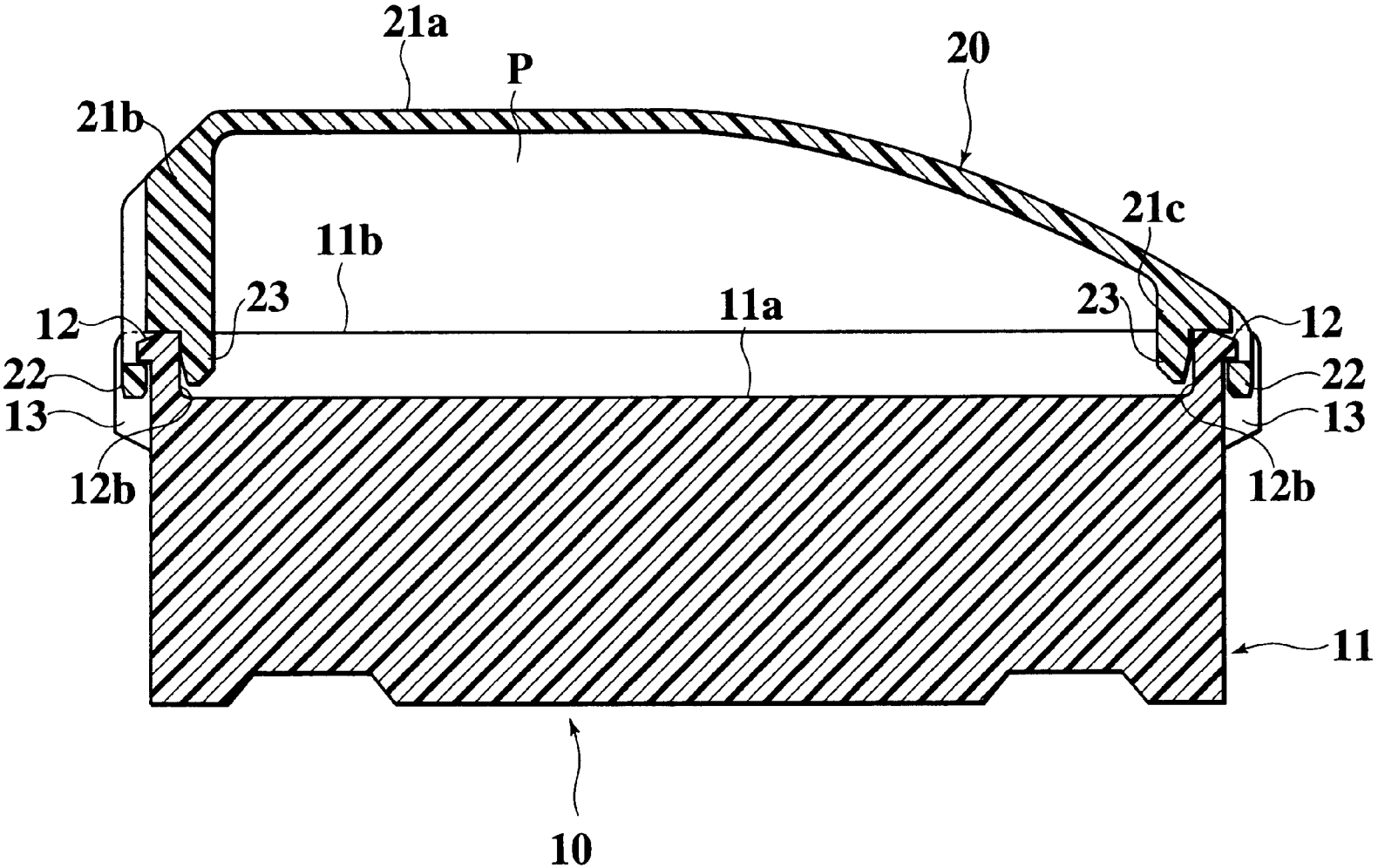
FIG. 3 is a sectional view illustrating a connector according to an embodiment of the present invention.
Figure 4:
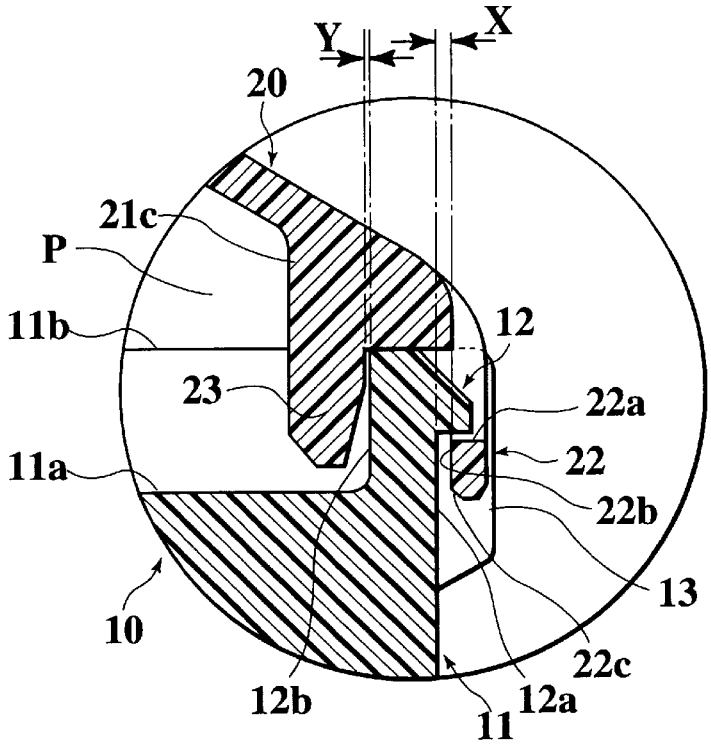
FIG. 4 is an enlarged sectional view illustrating a main part of the connector.

FIG. 3 is a sectional view illustrating an interfitting structure of a connector according to an embodiment of the present invention, and FIG. 4 is an enlarged sectional view illustrating a main part of the connector according thereto.

As Illustrated in FIG. 3, a connector 10 is constituted by a connector housing 11 made of synthetic resin and shaped like a substantially rectangular parallelepiped and a cover 20 made of synthetic resin and substantially horizontally U shaped in cross section and opening and closing a rear surface (one surface) 11*a* side of the connector housing 11. Whereby, it Is arranged that a wire harness not illustrated serving as an electric wire is drawn out from each of the electric wire accommodation spaces P on left and right sides which are formed between a peripheral wall 11*b* around the rear surface 11*a* of the connector housing 11 and a top wall portion 21*a* of the cover 20 in a state where the rear surface 11*a* side of the connector housing 11 is closed by the cover 20.

As illustrated in FIGS. 3 and 4, on upper and lower end portions (the left/right upper end portions in FIG. 3) of the peripheral wall 11*b* of the connector housing 11 there are projectively integrally formed a plurality of hook-shaped engaging pawls (engaging portions) 12 at equal intervals. At the positions, opposed to the respective engaging pawls 12, of long and short side wall portions 21*b*, 21*c* (the left/right side wall portions) of the cover 20 there are integrally formed engaging recessed portions (engaging portions) 22 each having a substantially rectangular hole portion 22*a* with or from which the corresponding engaging pawl 12 is engaged or disengaged. Further, on inner sides (insides) of the respective engaging recessed portions 22 of the cover 20 there are projectively integrally formed ribs 23 that abut on the inner side walls 12*b* of the engaging pawls 12 of the connector housing 11.

As illustrated in FIGS. 3 and 4, the respective engaging pawls 12 of the connector housing 11 are located between the corresponding engaging recessed portions 22 and ribs 23 of the cover 20. And, as illustrated in FIG. 4. between the inner side wall 22*b* of the engaging recessed portion 22 of the cover 20 and the outer side wall 12*a* of the corresponding engaging pawl 12 of the connector housing 11 there is provided a first clearance X and, between the inner side wall 12*b* of the engaging pawl 12 of the connector housing 11 and the corresponding rib 23 of the cover 20, there is provided a second clearance Y. The first clearance X is so set as to become larger than the second clearance Y ($X>Y>0$).

It is to be noted that on each of the outer side walls 12*a* of the respective engaging pawls 12 of the connector housing 11 there are projectively integrally formed a pair of guide projections 13, 13 concurrently serving as guides for the reinforcing rib and engaging recessed portion 22 of the cover. Also, in a lower end of the inner side wall 22*b* of each of the respective engaging recessed portions 22 of the cover 20 there is formed a tapered surface 22*c* for release of the rib.

As described above, according to the connector 10 of this embodiment, by clamping the respective engaging pawls 12 of the connector housing 11 between their corresponding respective engaging recessed portions 22 and ribs 23 of the cover 20, it is possible to reliably hold the engagement state between the respective engaging pawls 12 of the connector housing 11 and their corresponding holes 22*a* of the engaging recessed portions 22 of the cover 20. Also, even when an impact force is applied to the cover 20 due to, for example, a down drop of the connector 10, this impact force can be reliably absorbed by the respective ribs 23 of the cover 20 and their corresponding inner side walls 12*b* of the respective engaging pawls 12 of the connector housing 11 against which the ribs 23 abut. And it is possible to reliably prevent the resulting disengagement of the engaging recessed portions 22 of the cover 20 from their corresponding engaging pawls 12 of the connector housing 11 and the resulting damage of the engaging recessed portions 22 of the cover 20.

Also, since the first clearance X between the inner side walls 22*b* of the respective engaging recessed portions 22 of the cover 20 and their corresponding outer side walls 12*a* of the respective engaging pawls 12 of the connector housing 11 has been so set as to be larger than the second clearance Y between the inner side walls 12*b* of the respective engaging pawls 12 of the connector housing 11 and their corresponding ribs 23 of the cover 20, in a case where an impact force has been applied from the outside to the connector due to, for example, a down drop thereof, this impact force can be reliably absorbed by abutment of the respective ribs 23 against the inner side walls 12*b* of the respective engaging pawls 12 of the connector housing 11, with the result that there is no possibility that the respective engaging recessed portions 22 of the cover 20 will receive the impact force from their corresponding engaging pawls 12 of the connector housing 11.

Further, since no such directionality as in the prior art exists regarding the engagement between the respective engaging pawls 12 of the connector housing 11 and their corresponding engaging recessed portions 22 of the cover 20, it is possible to form using a mold not illustrated the respective engaging pawls 12 of the connector housing 11 and their corresponding respective engaging recessed portions 22 of the cover 20 by coaxial movement of the mold. As a result of this, it is possible to simplify a mold for forming the connector housing 11 and cover 20 and thereby manufacture the connector 10 at a low cost, as well as to increase the degree of freedom associated with the direction in which the wire harness is drawn out from the rear surface 11*a* side of the connector housing 11.

Figure 5:
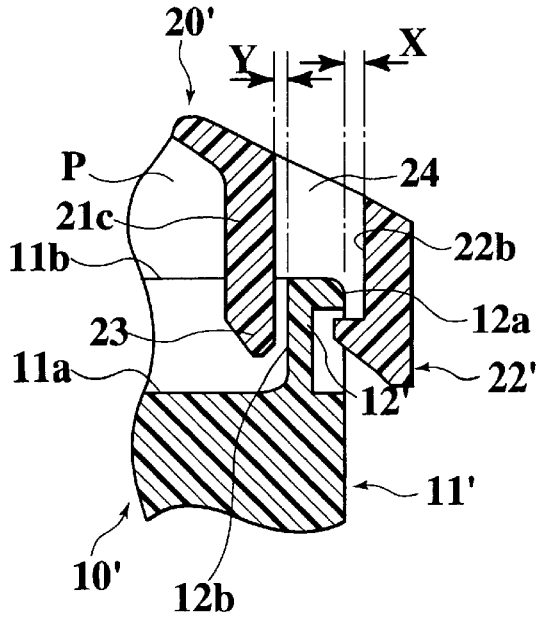
FIG. 5 is an enlarged sectional view illustrating a main part of a connector according to another embodiment of the present invention.

It is to be noted that although according to the above-described embodiment the engaging pawls 12 have been provided on the connector housing 11 and the engaging recessed portions 22 engaged with and disengaged from the engaging pawls 12 have been provided in the cover 20, as in the case of another embodiment illustrated in FIG. 5 the engaging portions of a connector housing 11' may be made to be engaging recessed portions 12' and the engaging portions of a cover 20' may be made to be hook-shaped engaging pawls 22'. In even this case, the same functions and effects as attainable with the above-described embodiment will be obtained. In said case, also, the first clearance x between the inner side walls 22*b* of the engaging pawls 22' of the cover 20' and the outer side walls 12*a* of the engaging recessed portions 12' of the connector housing 11' is so set as to be larger than the second clearance Y between the inner side walls 12*b* of the engaging recessed portions 12' of the connector housing 11' and their corresponding ribs 23 of the cover 20'. Also, between the inner side wall 22*b* of the engaging pawl 22' of the cover 20' and its corresponding rib 23, there is formed a draw-off hole 24 for release of the mold used.

While preferred embodiments of the present invention have been described using specific terms, such description is for illustrative purposes, and it is to be understood that changes and variations may be made without departing from the spirit or scope of the following claims.

What is claimed is:

1. An interfitting structure of a connector, comprising:

an engaging portion provided on a connector housing;

an engaging portion provided on a cover opening and closing one surface side of the connector housing; and a rib provided on an inner side of the engaging portion of the cover, the rib abutting against an inner side wall of the engaging portion of the connector housing, wherein the one surface side of the connector housing is covered by the cover by engagement of the both engaging portions with each other, thereby constructing a connector;

wherein a first clearance is provided between an inner side wall of the engaging portion of the cover and an outer side wall of the engaging portion of the connector housing; and wherein a second clearance is provided between the inner side wall of the engaging portion of the connector housing and the rib.

2. An interfitting structure of a connector according to claim 1, wherein the first clearance has been so set as to become larger than the second clearance.

3. An interfitting structure of a connector according to claim 1, wherein the connector housing and the cover are formed by a mold with the use of a synthetic resin;

wherein one of the engaging portion of the connector housing and the engaging portion of the cover is made into a hook-shaped engaging pawl; and wherein the other engaging portion is made to be an engaging recessed portion with or from which the engaging pawl is engaged or disengaged.

4. An interfitting structure of a connector according to claim 2, wherein the connector housing and the cover are formed by a mold with the use of a synthetic resin;

wherein one of the engaging portion of the connector housing and the engaging portion of the cover is made into a hook-shaped engaging pawl; and wherein the other engaging portion is made to be an engaging recessed portion with or from which the engaging pawl is engaged or disengaged.

* * * * *